US005441864A

United States Patent [19]

Yamaya

[11] Patent Number: 5,441,864

[45] Date of Patent: Aug. 15, 1995

[54] LIGHT-SENSITIVE SILVER HALIDE COLOR PHOTOGRAPHIC MATERIAL WITH HIGH SENSITIVITY AND SUPERIOR STABILITY

[75] Inventor: Yorihiro Yamaya, Hino, Japan

[73] Assignee: Konica Corporation, Japan

[21] Appl. No.: 204,649

[22] Filed: Mar. 1, 1994

[30] Foreign Application Priority Data

Mar. 5, 1993 [JP] Japan ..... 5-045340

[51] Int. Cl.[6] ..... G03C 1/005; G03C 1/015

[52] U.S. Cl. ..... 430/567; 430/569; 430/642

[58] Field of Search ..... 430/567, 569, 642

[56] References Cited

U.S. PATENT DOCUMENTS

| | | | |
|---|---|---|---|
| 4,288,535 | 9/1981 | Kanisawa et al. | 430/569 |
| 4,904,580 | 2/1990 | Komatsu et al. | 430/567 |
| 5,298,389 | 3/1994 | Possanza et al. | 430/642 |
| 5,378,600 | 1/1995 | Goan | 430/569 |

FOREIGN PATENT DOCUMENTS

| | | |
|---|---|---|
| 443475 | 8/1991 | European Pat. Off. . |
| 62-51 | 1/1987 | Japan . |
| 238444 | 10/1991 | Japan . |
| 42223 | 2/1992 | Japan . |

OTHER PUBLICATIONS

Patent Abstracts of Japan, vol. 13 No. 7 (P-810) [3355]; Jan. 10, 1989 JPA-63-214743; Sep. 7, 1988.

*Primary Examiner*—Charles L. Bowers, Jr.
*Assistant Examiner*—Mark F. Huff
*Attorney, Agent, or Firm*—Jordan B. Bierman; Bierman and Muserlian

[57] ABSTRACT

A silver halide light-sensitive photographic material comprising a support having on at least one side thereof a silver halide emulsion layer comprising a silver halide emulsion, wherein the silver halide emulsion is prepared by chemically-ripening the silver halide emulsion containing silver halide grains and a hydrophilic colloid in amounts of at least 7% by volume and at least 5% or more by weight, respectively, and preferably in the presence of iodide containing silver halide fine grains.

6 Claims, No Drawings

LIGHT-SENSITIVE SILVER HALIDE COLOR PHOTOGRAPHIC MATERIAL WITH HIGH SENSITIVITY AND SUPERIOR STABILITY

FIELD OF THE INVENTION

This invention relates to a light-sensitive silver halide photographic material, and more particularly to a light-sensitive silver halide photographic material having a high sensitivity and promising a high stability in its production process.

BACKGROUND OF THE INVENTION

In the production process of light-sensitive silver halide photographic materials (hereinafter also "light-sensitive material"), silver halide photographic emulsions having been subjected to chemical ripening are often stored for a certain time in a given environment before they are coated. On that occasion, ripening may proceed because of the presence of a spectral sensitizing dye having not reacted with silver halide grains and remaining in a very small quantity, sometimes resulting in an increase in fog of emulsions after they have been coated and dried or a change in sensitivity when the spectral sensitizing dye adsorbed on silver halide grains become released therefrom during storage.

In recent years, there is also an increasing demand for making light-sensitive materials higher in sensitivity, and means for improving both light absorption characteristics and developability of silver halide have been hitherto taken as means for achieving high sensitivity. For example, for the purpose of improving spectral sensitivity, Japanese Patent Publications Open to Public Inspection [hereinafter referred to as Japanese Patent O.P.I. Publication(s)] No. 51627/1963 and No. 77443/1984 disclose a method in which a water-soluble iodide is added to a silver iodobromide emulsion.

This method can be effective for increasing adsorbability of spectral sensitizing dyes on the surfaces of silver halide grains to adjust spectral sensitivity distribution or decrease the release of spectral sensitizing dyes in an environment of high humidity and high temperature, but has e disadvantage of causing a lowering of sensitivity when the water-soluble iodide is added to such an extent that the adsorbability of spectral sensitizing dyes is well increased. In addition, in this method, the resulting emulsions often undergo changes in sensitivity with time probably because the reaction of adsorption of iodide ions on the surfaces of silver halide grains is so rapid that the adsorption reaction is non-uniform and unstable.

Meanwhile, as a means for increasing sensitivity of silver chlorobromide emulsions and improving their aging stability, a method in which a water-soluble bromide or a water-soluble iodide is added is known in the art (Japanese Patent O.P.I. Publications No. 96331/982 and No. 5238/1984).

This method, however, requires adding the water-soluble bromide in an amount of 5 to 50 mol when it is added alone, and has also a disadvantage of causing an increase of ill influence (e.g., a lowering of sensitivity or a contrast reduction) due to flow-out of bromide ions to a processing solution during developing. In a method in which a water-soluble bromide and a water-soluble iodide are used in combination, very remarkable changes in photographic performance (e.g., a lowering of sensitivity, a contrast reduction and an increase in fog) may occur in the course of preparation of emulsions up to their coating, probably because of the non-uniformity or unstableness of the adsorption reaction of iodide ions.

Thus, conventional means for solving the problems of a lowering of spectral sensitivity and a deterioration of aging stability that may arise as silver halides composed in variety are made higher in sensitivity have been very unsatisfactory.

SUMMARY OF THE INVENTION

The present invention was made in order to solve the problems discussed above. An object of the present invention is to provide a light-sensitive silver halide photographic material that can be free from any changes in photographic performance in the course of preparation of emulsions up to their coating, has a stable quality and also has a high sensitivity.

The above object of the present invention can be achieved by what is constituted as follows:

(1) A light-sensitive silver halide photographic material comprising a support and provided at least one side thereof a silver halide emulsion layer, wherein the light-sensitive silver halide photographic material is prepared using such an emulsion that the volume ratio of a silver halide contained in a silver halide emulsion at the time of chemical ripening is not less then 7% and the amount of a hydrophilic colloid in the silver halide emulsion is not less than 5% by weight.

(2) The light-sensitive silver halide photographic material as described in paragraph (1), prepared using a silver halide emulsion to which fine silver halide grains having a smaller average grain volume than the grains in that emulsion and having a silver iodide content of not less than $1\times10^{-5}$ mol have been added.

DETAILED DESCRIPTION OF THE INVENTION

The present invention will be described below in detail.

In the present invention, the volume ratio of a silver halide is meant to be the ratio of the volume of a silver halide emulsion to the volume of a silver halide after completion of physical ripening and desalting (desalinization).

The volume ratio of a silver halide in the present invention is not less than 7%, preferably from 7 to 13%, and particularly preferably from 8 to 10%. If it is less than 7%, the present invention can be less effective. If it is more than 13%, silver halide grains may begin to flocculate, tending to cause an increase in fog or a lowering of volume ratio.

The silver halide grains used in the silver halide emulsion of the present invention may be of any form, as exemplified by a spherical form or a tabular form, and may preferably be monodisperse twinned crystal grains at least 50% of the whole projective area of which is held by grains having a thickness of 0.3 μm or less and a value of grain diameter/grain thickness (hereinafter "aspect ratio") of 2 or more. They may more preferably be monodisperse twinned crystal grains at least 50% of the whole projective area of which is held by grains having a thickness of 0.2 μm or less and an aspect ratio of 3 to 8.

In the present invention, the grain diameter (grain size) is a diameter obtained when a projected image of a grain is calculated as a circular image having the same area. The grain thickness refers to a distance between the two principal planes of a tabular grain that oppose each other.

The projective area of a grain can be obtained from the sum of this grain area. The projective area from which the whole projective area and the grain diameter are determined can be obtained by electron-microscopic observation of a sample of silver halide crystals distributed on a sample stand in such a way that none of grains overlap. The grain thickness can be measured by electron-microscopic observation of the sample at an oblique position.

The grain size can be obtained, for example, by photographing the grains at magnifications of 10,000 to 50,000 using an electron microscope and actually measuring the diameters of grains on a print or projective area thereof. (The number of grains measured may be 1,000 or more selected at random.)

Monodisperse emulsions having a particularly preferred monodispersity in the present invention are those having a breadth of distribution calculated by the following expression, of 30% or less, and more preferably 20% or less.

(grain size standard deviation)/(average grain size) $\times 100$=breadth of distribution (%).

Here the grain size is measure by the method described above, and the average grain size is based on a simple average.

Average grain size$=\Sigma d_i n_i/\Sigma n_i$

In the present invention, the twinned crystal refers to a silver halide crystal having at least one twin plane in one grain. The modes of twinned crystals are detailed in a report by Klein and Moisar, Photographische Korrespondenz, Vol. 99, page 99, and ditto, Vol. 100, page 57.

Two or mope twin planes of a twinned crystal may be in parallel or not in parallel. The twin planes can be directly observed using an electron microscope. Alternatively, they can also be observed from cross sections of samples prepared by dispersing a silver halide in a resin, followed by solidification and then cutting into ultra-thin slices.

The silver halide twinned crystal grains that constitute the silver halide emulsion of the present invention may preferably mainly have two or more parallel twin planes, more preferably even-numbered parallel twin planes, and particularly preferably two parallel twin planes.

Here, what is meant by "twinned crystals mainly having two or mope parallel twin planes" is that the twinned crystal grains having two or more parallel twin planes are 50% or more in number, preferably60% or more, and particularly preferably 70% or more, when the grains are counted in the order of larger size grains.

The silver halide grains in the silver halide emulsion may have any composition. More specifically, any silver halide such as silver bromide, silver iodobromide, silver chlorobromide, silver chloroiodobromide or silver chloride may be used as the silver halide. With regard to silver halide distribution in a grain, it may be of uniform composition, or of halogen composition different between the inner side and the outer side. It may also be of layered structure (core/shell structure).

As methods for obtaining the monodisperse emulsions, they can be obtained by a method in which a water-soluble silver salt solution and a water-soluble halide solution are added in a gelatin solution containing seed grains, by double jet at precipitation while controlling their pAg and pH. As a method used in the present invention, the method employing double jet precipitation is particularly preferable.

In the double jet precipitation, the amount of the soluble silver salt solution and soluble halide solution added in a reaction vessel may preferably be 2 to 10 times that of a hydrophilic colloid solution containing seed grains. The seed grains in the hydrophilic colloid solution beforehand made present in the reaction mixture may preferably be in a concentration of from 0.5 to 5%. The rate of addition may be determined by making reference to Japanese Patent O.P.I. Publications No. 48521/1979 and No. 49938/1983.

The silver halide emulsion of the present invention may be controlled to have a pAg ion concentration suited for chemical sensitization, by a suitable method after the growth of silver halide grains has been completed. For example, this can be done by flocculation process, noodle washing, etc., which are the methods disclosed in Research Disclosure No. 17643.

When chemical sensitization is carried out, usual sulfur sensitization, reduction sensitization or noble metal sensitization and any combination of these may be employed. Specific chemical sensitizers may include sulfur sensitizers such as allylthiocarbamide, thiourea, thiosulfate, thioether and cystine; noble metal sensitizers such as potassium chloroaurate, aurous thiosulfate and potassium chloropalladate; and reduction sensitizers such as tin chloride, phenylhydrazine and reductone.

The silver halide emulsion of the present invention may be spectrally sensitized using a cyanine dye or the like. Spectral sensitizing dyes may each be used alone or they may be used in combination. Spectral sensitizing dyes are often used in combination especially for the purpose of supersensitization.

In the photographic emulsion of the present invention, various types of hydrophilic colloid may be used as binders. This colloid may include, for example, gelatin, colloidal albumin, polysaccharide, cellulose derivatives, synthetic resins, polyvinyl compounds including, for example, a polyvinyl alcohol derivative, and acrylamide polymers, which are hydrophilic colloids commonly used in the field of photography.

In the present invention, the hydrophilic colloid may preferably be used in an amount of not less than 5% by weight in the silver halide emulsion when chemical ripening is carried out. Its use in an amount of not less than 5% by weight makes it possible to prevent fog from increasing with an increase in the volume ratio.

The present invention can be made more highly effective when, in an emulsion being chemically sensitized, fine silver halide grains having a smaller average grain volume and a larger silver iodide content (mol%) than the grains in that emulsion are added. That is, on the fine silver halide grains, the adsorption reaction uniformly takes place on their surfaces, compared with conventional water-soluble iodides, because of a slow adsorption reaction of iodide ions on the surfaces of the emulsion grains being chemically sensitized. Hence, an emulsion having a high stability after chemical sensitization has been completed can be obtained without causing a lowering of sensitivity.

The fine silver halide grains used in the present invention may preferably composed of silver iodide, or may also be composed of silver iodobromide or silver chloroiodide. The fine silver halide grains may preferably have a good monodispersity, and may preferably be prepared by double jet precipitation while controlling temperature, pH and pAg. The fine silver halide grain may preferably have a grain size of 0.2 μm or less, and more preferably from 0.02 to 0.1 μm.

The fine silver halide grains may preferably be added in an amount of not more than $1\times10^{-2}$ mol per mol of the parent emulsion, and more preferably from $1\times10^{-5}$ mol to $2\times10^{-3}$ mol per mol of the parent emulsion.

The fine silver halide grains may preferably be added at the step of chemical ripening. The step of chemical ripening herein referred to indicates the course that starts with completion of the physical ripening and desalting of the parent emulsion, extends through addition of the chemical sensitizer and ends with operation thereafter carried out to stop the chemical ripening. A method for stopping the chemical ripening is known to include a method in which the temperature is dropped, a method in which the pH is lowered and a method in which a chemical ripening terminator is used. Any methods may be used. The fine silver halide grains may be added dividedly several times at intervals, or another emulsion having been subjected to chemical ripening may be further added after the fine silver halide grains have been added.

When the fine silver halide grains are added, the temperature of the parent emulsion should preferably be in the range of from 30° to 80° C., and more preferably in the range of from 40° to 65° C.

In the light-sensitive material of the present invention, photographic hardening agents usually used in its coating solutions may be used, as exemplified by hardening agents of an aldehyde type, an aziridine type (e.g., those disclosed in PB Report 19921, U.S. Pat. No. 2,950,197, U.S. Pat. No. 2,964,404, U.S. Pat. No. 2,983,611 and U.S. Pat. No. 3,271,175, Japanese Patent Examined Publication No. 40898/1971 and Japanese Patent O.P.I. Publication No. 91315/1976), an isoxazole type (e.g., those disclosed in U.S. Pat. No. 331,609), an epoxy type (e.g., those disclosed in U.S. Pat. No. 3,047,394, West German Patent No. 1,085,663, British Patent No. 1,033,518 and Japanese Patent Examined Publication No. 35495/1973), a vinylsulfone type (e.g., those disclosed in PB Report 19920, West German Patent No. 1,100,942, British Patent No. 1,251,091, Japanese Patent O.P.I. Publication No. 62250/1975 and U.S. Pat. No. 3,490,911), an acryloyl type (e.g., those disclosed in Japanese Patent O.P.I. Publication No. 116154/1974 and U.S. Pat. No. 3,640,720) and a carbodiimide type (e.g., those disclosed in U.S. Pat. No. 2,938,892 and Japanese Patent Examined Publication No. 38715/1971), as well as those of a maleimide type, an acetylene type, a methanesulfonate type, a triazine type and a polymer type.

It is also possible to use a thickening agent including, for example, those disclosed in U.S. Pat. No. 3,167,410 and Belgian Patent No. 558,143; a gelatin plasticizer including polyols (e.g., those disclosed in U.S. Pat. No. 2,960,404, Japanese Patent Examined Publication No. 4939/1968 and Japanese Patent O.P.I. Publication No. 63715/1973) and latexes including those disclosed in U.S. Pat. No. 766,979, French Patent No. 1,395,544 and Japanese Patent Examined Publication No. 43125/1973; and a matting agent including those disclosed in British Patent No. 1,221,980.

In the component factors of the light-sensitive material of the present invention, a coating auxiliary may also be used, as exemplified by saponin or sulfosuccinic acid type surface active agents (e.g., those disclosed in British Patent No. 548,532) and anionic surface active agents (e.g., those disclosed in Japanese Patent Examined Publication No. 18166/1968, U.S. Pat. No. 3,514,293, French Patent No. 2,025,688 and Japanese Patent Examined Publication No. 10247/1968).

In order to prevent sensitivity from lowering and fog from occurring in the production process of the light-sensitive material and during its storage or processing, various compounds may be added to the photographic emulsion described above. For example, very large number of compounds such as many heterocyclic compounds, mercury-containing compounds, mercapto compounds and metal salts are known in the art, including 4-hydroxy-6-methyl-1,3,3a,7-tetrazaindene, 3-methylbenzothiazole and 1-phenyl-5-mercaptotetrazole. Examples of preferred compounds are disclosed in K. Maes, The Theory of the Photographic Process, Third Edition, 1966, with reference to the original text, and also disclosed in Japanese Patent O.P.I. Publications No. 81024/1974, No. 6306/1975, No. 19429/1975, U.S. Pat. No. 3,850,639, etc., as antifoggants. Besides, in the working of the present invention, various techniques used in photographic techniques may be applied.

EXAMPLES

The present invention will be described below by giving Examples. The present invention is by no means limited by these.

Example 1

Preparation of seed emulsion: Seed emulsion S-1 with a high monodispersity was prepared in the following way.

| | |
|---|---|
| $A_1$: | |
| Ossein gelatin treated with hydrogen peroxide | 11.3 g |
| Potassium bromide | 6.72 g |
| By adding water, made up to | 1,130 cc |
| $B_1$: | |
| Silver nitrate | 170 g |
| By adding water, made up to | 227.5 cc |
| $C_1$: | |
| Ossein gelatin | 4.56 g |
| Potassium bromide | 119 g |
| By adding water, made up to | 227.5 cc |
| $D_1$: | |
| Ammonia water (28%) | 66.6 cc |

To the solution $A_1$ vigorously stirred at 40° C., solutions $B_1$ and $C_1$ were added by double jet precipitation to form nuclei. After the addition was completed, the temperature of the mixed solution was dropped to 20° C., the potential was adjusted to 40 mV, and solution $D_1$ was added in 20 seconds to carry out ripening for 5 minutes.

Thereafter, the pH was adjusted to 6.0 using acetic acid, and precipitation and desalting were carried out using an aqueous solution of DEMOL, trade name, available from Kao Atlas Co., and an aqueous magnesium sulfate solution, followed by washing with water.

The above seed emulsion was further re-dispersed using 23 g of ossein gelatin.

The resulting seed emulsion was observed using an electron microscope to ascertain that it was a monodisperse silver bromide emulsion with an average grain size of 0.28 μm and a breadth of distribution of 30%.

Preparation of tabular grains:

Using the seed emulsion S-1 and the following solutions, silver halide emulsion Em-a mainly comprised of tabular twinned crystals was prepared.

| | |
|---|---|
| $E_1$: | |
| Ossein gelatin | 6.49 g |
| Disodium propyleneoxy-polyethyleneoxy-disuccinate (10% methanol solution) | 1.1 cc |
| The above seed emulsion corresponding to | 0.62 mol |
| By adding water, made up to | 500 cc |
| $F_1$: | |
| Ossein gelatin | 1.69 g |
| Potassium bromide | 107.2 g |
| Potassium iodide | 2.30 g |
| By adding water, made up to | 504 cc |
| $G_1$: | |
| Silver nitrate | 170 g |
| By adding water, made up to | 504 cc |

To the solution $E_1$ vigorously stirred at 65° C., solutions $F_1$ and $G_1$ were added by controlled double jet precipitation. They were added at a flow rate so controlled as to be 80% of the flow rate at which new nuclei were formed. During their addition, the potential was kept at −10 mV at 65° C. using an aqueous potassium bromide solution prepared for the control.

After the addition was completed, the pH was adjusted 6.0, and then an anhydrous sodium 5,5'-dichloro-9-ethyl-3,3'-di (3-sulfopropyl)oxycarbocyanine (spectral sensitizing dye A) was added in an amount of 283 mg per mol of silver halide. After it had been well adsorbed, desalting was carried out in the same manner as in the seed emulsion.

The potential and pH of the emulsion at 50° C. were 50 mV and 5.85, respectively.

About 3,000 grains of Em-a were observed and measured using an electron microscope to analyze their configuration. Results obtained were as follows:

Proportion of hexagonal tabular crystals with respect to the whole projective area: 80%

Average grain size (calculated as circular grains) of the hexagonal tabular crystals: 0.85 μm Average grain thickness of the hexagonal tabular crystals: 0.32 μm Aspect ratio of the hexagonal tabular crystals: 2.7

Monodispersity of the hexagonal tabular crystals: 20%

The volume ratio of silver halide with respect to the total volume of the resulting Em-a was 9%.

Em-b to Em-f with different volume ratios were also prepared in the same manner as in the preparation of Em-a except that the amount of solution $E_1$, the concentration of potassium bromide of solution $F_1$ and silver nitrate of solution $G_1$ was changed as shown in Table 1.

TABLE 1

| Emulsion | Amount of *1 $E_1$ solution | Concentration of *2 potassium bromide and silver nitrate | Volume ratio (%) |
|---|---|---|---|
| Em-a | 100 | 100% | 9 |
| Em-b | 120 | 83% | 7.5 |
| Em-c | 138 | 72% | 6.5 |
| Em-d | 180 | 56% | 5 |
| Em-e | 75 | 133% | 12 |
| Em-f | 64 | 156% | 14 |

*1 Values obtained when the amount of $E_1$ solution is assumed as 100.

*2 Values obtained when the concentration of potassium bromide and silver nitrate in Em-a is assumed as 100.

Preparation of fine silver halide grains: Solution S:

| | |
|---|---|
| Solution S: | |
| Gelatin | 42 g |
| Potassium iodide | 9 g |
| Sodium citrate | 3 g |
| By adding water, made up to | 110 cc |
| Solution T: | |
| Silver nitrate | 140 g |
| By adding water, made up to | 140 cc |
| Solution U: | |
| Potassium iodide | 147 g |
| By adding water, made up to | 350 cc |
| Solution V: | |
| Silver nitrate | 14 g |
| By adding water, made up to | 280 cc |

Solution S was put in a reaction vessel, and kept at pAg of 13.9, to which solutions T and U were added by controlled double jet precipitation over a period of 30 minutes. Thereafter, solution V was instantaneously added to prepare a fine silver halide grains. This emulsion had an average grain size of 0.07 μm.

Preparation of Em-1 to Em-10:

Em-1 to Em-10 were each kept at 50° C., and 126 mg of spectral sensitizing dye A and 1.3 mg of anhydrous sodium 5,5'-di-(butoxycarbonyl)-1,1'-diethyl-3,3'-di(4-sulfobutyl) benzoimidazolocarbocyanine (spectral sensitizing dye B) were added thereto.

After 10 minutes, chloroaurate, sodium thiosulfate and ammonium thiocyanate were added in suitable amounts to carry out chemical ripening. 40 minutes after initiation of the chemical ripening, S-2 was added in an amount of 120 mg per mol of silver halide. Thereafter, the amount of gelatin was adjusted so that the amount of hydrophilic colloid came as shown in Table 2, followed by addition of 4-hydroxy-6-methyl-1,3,3a,7-tetrazaindene in an amount of 2.4 g per mol of silver halide. Then, the temperature was dropped to stop the chemical ripening. Em-1 to Em-10 were thus obtained.

Preparation of Em-11 to Em-15:

Em-11 to Em-15 were obtained in the same manner as Em-1 to Em-10 except that S-2 was replaced with potassium iodide added in an amount of 200 mg per mol of silver halide 15 minutes after completion of the chemical ripening. The amount of gelatin was also adjusted so that the amount of hydrophilic colloid came as shown in Table 2.

TABLE 2

| | Emulsion used | Amount of colloid (wt. %) |
|---|---|---|
| Em-1 | Em-b | 5.5 |
| Em-2 | Em-a | 4 |
| Em-3 | Em-a | 5.5 |
| Em-4 | Em-a | 8 |
| Em-5 | Em-e | 5.5 |
| Em-6 | Em-c | 4 |
| Em-7 | Em-c | 5.5 |
| Em-8 | Em-d | 5.5 |
| Em-9 | Em-f | 4 |
| Em-10 | Em-f | 5.5 |
| Em-11 | Em-b | 5.5 |
| Em-12 | Em-a | 4 |
| Em-13 | Em-a | 5.5 |
| Em-14 | Em-c | 5.5 |
| Em-15 | Em-f | 5.5 |

Preparation of coating solutions:

To Em-1 to Em-15 each, the following additives were added to prepare coating solutions. The amount of each additive is indicated as amount per mol of silver halide.

| | |
|---|---|
| 1-Phenyl-5-mercaptotetrazole | 10 mg |
| 1-Trimethylolpropane | 14 mg |
| t-Butylcatechol | 68 mg |
| Polyvinyl pyrrolidone (molecular weight: 10,000) | 850 mg |
| Styrene/maleic anhydride copolymer | 2.0 g |
| Nitrophenyl-triphenylphosphonium chloride | 50 mg |
| Ammonium resorcin-4-sulfonate | 1.7 g |
| 1,3-Dimethylol-1-bromo-1-nitromethane | 6.2 mg |
| $C_4H_9OCH_2CH(OH)CH_2N(CH_2COOH)_2$ | 700 mg |
| Monosodium 2-anilino-2,4-dimercapto-s-triazine | 42 mg |
| 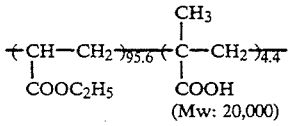 (Mw: 20,000) | 18 g |
| 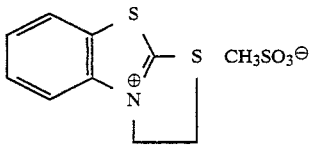 | 28 mg |

Additives used in a protective layer were as show below. The amount of each additive is indicated as amount per 1 g of gelatin.

| | |
|---|---|
| Polymethyl methacrylate (average particle diameter: 5 μm) | 21 mg |
| Polymethyl methacrylate (average particle diameter: 3 μm) | 28 mg |
| Glyoxal | 50 mg |
| Sodium sulfate of ethylene oxide 12 mol adduct of 2,4-dinonylphenol | 28 mg |
| Ethylene oxide 12 mol adduct of 2,4-dinonylphenol | 7 mg |
| Sodium i-amyl-decyl-sulfosuccinate | 7 mg |
| $C_{11}H_{23}CONH(CH_2CH_2O)_5H$ | 62 mg |
| Mixture of 2-Methyl-4-thiazolin-3-one, 5-chloro-2-methyl-4-thiazolin-3-one and 5,6-dichloro-2-methyl-4-thiazolin-3-one | 0.9 mg |

The above coating solutions were each uniformly coated on both sides of a 180 μm thick blue-colored polyethylene terephthalate base having been subjected to subbing, immediately after preparation of the coating solutions, after storage at 35° C. for 2 hours, after storage at 35° C. for 4 hours or after storage at 35° C. for 8 hours, followed by drying. Samples were thus produced.

On all samples, coating weight of silver was adjusted so as to be 2.0 g/m$^2$ per one side, and that of gelatin 3.5 g/m$^2$ per one side.

Evaluation of sensitivity

Each sample was held between X-ray photographic intensifying screens, and exposed to X-rays through a B-type penetrometer, followed by photographic processing using an automatic processor, according to the following processing steps.

Processing steps:

| Steps | Processing temp. (°C.) | Processing time (sec) | Amount of replenishment |
|---|---|---|---|
| Inserting | — | 1.2 | 270 cc/m$^2$ |
| Developing + cross-over | 35 | 14.6 | 430 cc/m$^2$ |

-continued

| Steps | Processing temp. (°C.) | Processing time (sec) | Amount of replenishment |
|---|---|---|---|
| Fixing + cross-over | 33 | 8.2 | 7.0 L/min |
| Washing + cross-over | 18 | 7.2 | |
| Squeegeeing | 40 | 5.7 | |
| Drying | 45 | 8.1 | |
| Total | — | 45.0 | |

Each tank of the automatic processor used had the following capacity: Developing tank: 16 liter; fixing tank: 10 liter; and washing tank: 10 liter. A bag made of 20 mesh polyethylene woven fabric was filled with 200 g of KLINCA 205 (trade name; available from Nichihan Kenkyusho; ceramics mainly composed of $SiO_2.Al_2O_3.Ag^+$; particle size: 1.0 to 1.5 mm; specific gravity: 2.5 to 2.6), and was immersed in the vicinity of a washing-water feed port of the washing tank. The drying was carried out using an infrared heater (220° C.) and hot air (60° C.) in combination.

The insertion of films was detected using an infrared sensor. The area of 10 sheets of film of a 10×12 inch size was detected and 210 cc of a developing solution and 320 cc of a fixing solution were replenished.

The developing solution and the fixing solution each had the following formulation.

| Formulation of developing solution | |
|---|---|
| Part-A (for making up to 10.8 liter solution) | |
| Sodium hydroxide | 340 g |
| Potassium sulfite (aqueous 50% solution) | 2,150 g |
| Diethylenetriaminepentaacetic acid | 32.3 g |
| Sodium carbonate | 108 g |
| 1-Phenyl-5-mercaptotetrazole | 15 mg |
| 5-Methylbenzotriazole | 150 mg |
| Hydroquinone | 280 g |
| By adding water, made up to | 3,600 cc |
| Part-B (for making up to 10.8 liter solution) | |
| Glacial acetic acid | 158 g |
| Triethylene glycol | 144 g |
| 1-Phenyl-3-pyrazolidone | 19.5 g |
| 5-Nitroindazole | 0.32 g |
| N-acetyl-D,L-penicillamine | 0.11 g |
| By adding water, made up to | 3,600 cc |

Part-A and part-B are mixed, and made up to 10.8 liter by adding water.

| Formulation of starter (for making up to 1 liter solution) | |
|---|---|
| Glacial acetic acid | 138 g |
| Potassium bromide | 325 g |
| 5-Methylbenzotriazole | 1.5 g |
| $CH_3N(CH_2CH_2CH_2NHCONHCH_2CH_2SC_2H_5)_2$ | 20 mg |

Made up to 1 liter by adding pure water.

The starter was added in an amount of 20 cc per liter of the developing solution.

| Formulation of fixing solution | |
|---|---|
| Part-A (for making up to 16.4 liter solution) | |
| Ammonium thiosulfate (70 wt/vol %) | 3,460 g |
| Sodium sulfite | 150 g |
| Sodium acetate trihydrate | 350 g |
| Sodium citrate | 43 g |
| Gluconic acid | 33 g |
| Boric acid | 26 g |
| Glacial acetic acid | 120 g |

-continued

| Formulation of fixing solution | |
|---|---|
| By adding water, made up to | 5,000 cc |
| Part-B (for making up to 16.4 liter solution) | |
| Aluminum sulfate | 56 g |
| Sulfuric acid (50%) | 91 g |
| By adding water, made up to | 1,000 cc |

Part-A and part-B are mixed, and made up to 16.4 liter by adding water.

Sensitivity was evaluated on the samples having been developed in the manner described above. The sensitivity was indicated as a relative value assuming as 100 a reciprocal of the amount of exposure energy in which the sample coated with Em-1 immediately after its coating solution was prepared gave a density of fog+1.0.

Results obtained are shown in Table 3.

Evaluation of fog

Fog values were measured in respect of the samples obtained by coating the coating solutions of Em-1 to Em-15 immediately after their preparation and the samples obtained by coating them after storage at 35° C. for 8 hours. Results obtained are shown in Table 3. In Table 3, the fog value refers to a value obtained by subtracting the value of base density from the value of measured density.

TABLE 3

| Sample No. | Volume ratio (%) | Amount of hydrophilic colloid (wt. %) | Iodide | Sensitivity After preparation of coating solution Imm. | 2 hrs | 4 hrs | 8 hrs | Fog After preparation of coating solution Imm. | 8 hrs |
|---|---|---|---|---|---|---|---|---|---|
| 1 (Y) | 7.5 | 5.5 | AgI | 100 | 100 | 100 | 101 | 0.04 | 0.04 |
| 2 (X) | 9 | 4 | AgI | 101 | 101 | 101 | 101 | 0.05 | 0.10 |
| 3 (Y) | 9 | 5.5 | AgI | 100 | 100 | 100 | 100 | 0.04 | 0.04 |
| 4 (Y) | 9 | 8 | AgI | 99 | 99 | 99 | 99 | 0.03 | 0.03 |
| 5 (Y) | 12 | 5.5 | AgI | 100 | 100 | 100 | 101 | 0.04 | 0.04 |
| 6 (X) | 6.5 | 4 | AgI | 101 | 103 | 106 | 112 | 0.04 | 0.13 |
| 7 (X) | 6.5 | 5.5 | AgI | 100 | 103 | 106 | 111 | 0.05 | 0.06 |
| 8 (X) | 5 | 5.5 | AgI | 101 | 104 | 110 | 118 | 0.04 | 0.06 |
| 9 (X) | 14 | 4 | AgI | 100 | 100 | 100 | 101 | 0.06 | 0.17 |
| 10 (Y) | 14 | 5.5 | AgI | 100 | 100 | 100 | 101 | 0.05 | 0.06 |
| 11 (Y) | 7.5 | 5.5 | KI | 80 | 81 | 82 | 84 | 0.04 | 0.04 |
| 12 (X) | 9 | 4 | KI | 81 | 82 | 83 | 84 | 0.04 | 0.11 |
| 13 (Y) | 9 | 5.5 | KI | 80 | 81 | 82 | 83 | 0.05 | 0.05 |
| 14 (X) | 6.5 | 5.5 | KI | 80 | 82 | 86 | 92 | 0.04 | 0.05 |
| 15 (Y) | 14 | 5.5 | KI | 80 | 81 | 82 | 83 | 0.06 | 0.07 |

X: Comparative Example,
Y: Present Invention

As shown in Table 3, the samples making use of the emulsions having the volume ratio of the present invention are improved in the stability of sensitivity after preparation of coating solutions. Use of the hydrophilic gelatin in an amount of not less than 5% by weight has made it possible to prevent fog from increasing with an increase in the volume ratio.

Moreover, when, with regard to the iodide added during the chemical ripening, the water-soluble iodide is replaced with the fine silver halide grains having a larger silver iodide content, the stability of sensitivity can be more improved and also the sensitivity can be made higher.

As described above, the present invention has made it possible to provide a light-sensitive silver halide photographic material that can be free from any changes in photographic performance in the course of preparation of emulsions up to their coating, while maintaining its high sensitivity.

What is claimed is:

1. A silver halide light-sensitive photographic material comprising a support having on at least one side thereof a silver halide emulsion layer comprising a silver halide emulsion, said silver halide emulsion being prepared by a process comprising formation of silver halide grains, and chemical ripening of said silver halide grains in the presence of iodide-containing silver halide fine grains in an amount of $1\times10^{-2}$ mole or less per mole of said silver halide grains, wherein at the time of said chemical ripening, said silver halide emulsion contains said silver halide grains in an amount of 7% to 13%, by volume, and a hydrophilic colloid in an amount of at least 5%, by weight.

2. The silver halide photographic material of claim 1, wherein said fine grains comprise silver iodide.

3. The silver halide photographic material of claim 1, wherein said silver halide grains are twinned crystal grains having a thickness of 0.3 μm or less and a ratio of a diameter to the thickness of 2 or more, and accounting for 50% or more of a total projected area of grains contained in the emulsion.

4. The silver halide photographic material of claim 1, wherein said hydrophilic colloid comprises gelatin.

5. A method of preparing a silver halide emulsion comprising forming silver halide grains, and chemically ripening said silver halide grains in the presence of iodide-containing silver halide fine grains present in an amount of $1\times10^{-2}$ mol or less, per mole of silver halide grains, at the time of said chemical ripening, said silver halide emulsion containing said silver halide grains in an amount of 7% to 13% by volume, and a hydrophilic colloid in an amount of at least 5%, by weight.

6. The method of claim 5, wherein said chemical ripening is carried out in the presence of silver iodide fine grains having a diameter of 0.02 to 0.1 μm.

* * * * *